US010625912B2

(12) United States Patent
Schmid

(10) Patent No.: US 10,625,912 B2
(45) Date of Patent: Apr. 21, 2020

(54) CONTAINER CLOSURE WITH PERFORATOR AND CAPTIVE SEAL RING

(71) Applicant: MONTFORT KUNSTSTOFFTECHNIK GMBH, Koblach (AT)

(72) Inventor: Martin Schmid, Sulz (AT)

(73) Assignee: MONTFORT SOLUTIONS GMBH, Koblach (AT)

( * ) Notice: Subject to any disclaimer, the term of this patent is extended or adjusted under 35 U.S.C. 154(b) by 72 days.

(21) Appl. No.: 16/068,139

(22) PCT Filed: Jan. 6, 2017

(86) PCT No.: PCT/EP2017/050265
§ 371 (c)(1),
(2) Date: Jul. 5, 2018

(87) PCT Pub. No.: WO2017/118731
PCT Pub. Date: Jul. 13, 2017

(65) Prior Publication Data

US 2019/0023465 A1 Jan. 24, 2019

(30) Foreign Application Priority Data

Jan. 8, 2016 (DE) ..... 10 2016 200 162

(51) Int. Cl.
*B65D 51/22* (2006.01)
*B65D 47/08* (2006.01)

(52) U.S. Cl.
CPC ..... *B65D 51/227* (2013.01); *B65D 47/0838* (2013.01); *B65D 2101/0038* (2013.01);
(Continued)

(58) Field of Classification Search
CPC ..... B65D 5/748; B65D 5/747; B65D 5/54; B65D 51/227; B65D 51/226;
(Continued)

(56) References Cited

U.S. PATENT DOCUMENTS 3,182,858 A * 5/1965 Beaudoin ..... B65D 51/225 222/83
4,307,821 A * 12/1981 McIntosh ..... B65D 41/3442 215/256

(Continued)

FOREIGN PATENT DOCUMENTS

DE 102014207652 A 10/2014

*Primary Examiner* — Robert J Hicks
(74) *Attorney, Agent, or Firm* — Andrew Wilford

(57) ABSTRACT

Container closure (1) having a closure bottom part (5) and a cap (2), and also a mouthpiece (3) and an apparatus for piercing a closure film, wherein a tamper-evident band (6) is provided which ensures that the closure film can be pierced by the apparatus only when the tamper-evident band (6) has been removed, wherein the tamper-evident band (6) is arranged between the closure bottom part (5) and the cap (2), characterized in that the tamper-evident hand (6) is designed as a closed ring which is connected to a bottom edge of the cap (2) via at least one separable web (8), and the cap (2) is mounted on the closure bottom part (5) so as to be able to be respectively rotated and pressed in regions.

9 Claims, 3 Drawing Sheets

Figure 1:
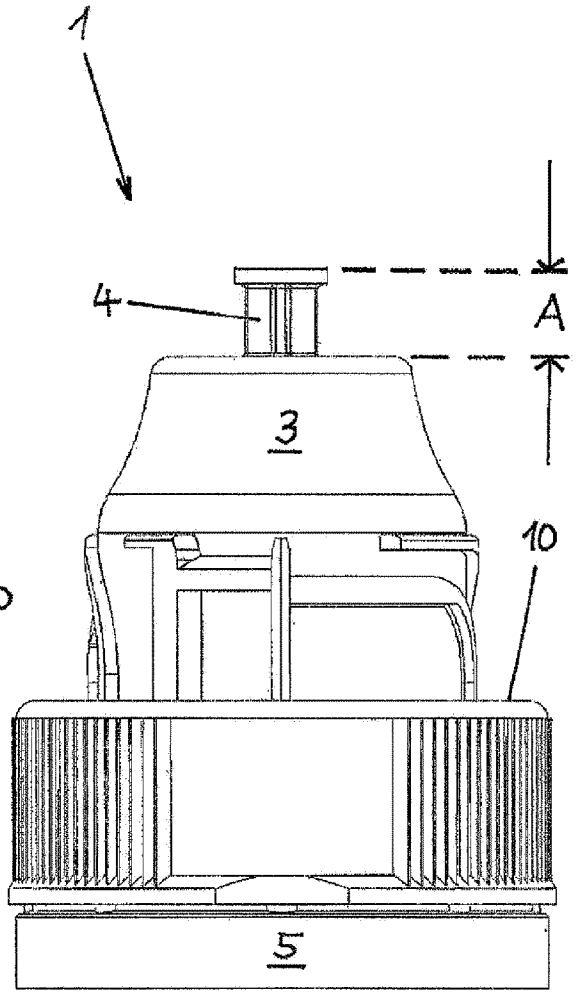

(52) U.S. Cl.
CPC ..... *B65D 2251/0025* (2013.01); *B65D 2251/0093* (2013.01)

(58) Field of Classification Search
CPC ..... B65D 51/221; B65D 51/22; B65D 51/20; B65D 51/222; B65D 47/0838; B65D 47/0833; B65D 47/0804; B65D 47/08; B65D 41/32; B65D 41/3428
USPC ..... 215/237, 235, 297, 296, 295, 253, 250; 220/212, 254.9, 254.1, 258.4, 258.3, 220/258.1, 266, 265, 810; 229/200, 204
See application file for complete search history.

(56) References Cited

U.S. PATENT DOCUMENTS

| | | | | |
|---|---|---|---|---|
| 4,722,449 | A | 2/1988 | Dubach | |
| 5,862,953 | A * | 1/1999 | Long, Jr. ..... | B65D 41/3447 222/153.06 |
| 2009/0101618 | A1 | 4/2009 | Seelhofer | |

* cited by examiner

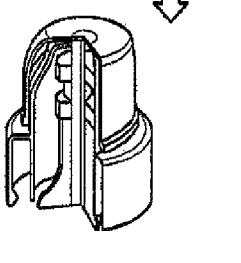
Fig. 7
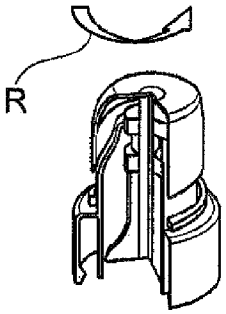
Fig. 8
Fig. 9
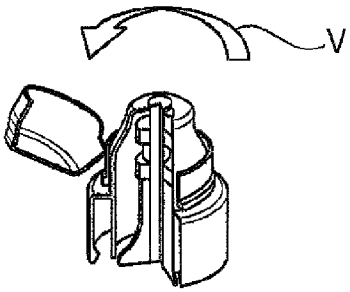
Fig. 10
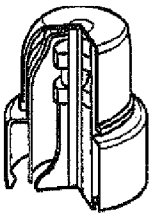
Fig. 11

CONTAINER CLOSURE WITH PERFORATOR AND CAPTIVE SEAL RING

CROSS REFERENCE TO RELATED APPLICATIONS

This application is the US-national stage of PCT application PCT/EP2017/050265 filed 6 Jan. 2016 and claiming the priority of German patent application 102016200162.0 itself filed 8 Jan. 2016.

The invention relates to a container closure having a closure bottom part and a cap, and also a mouthpiece and means for piercing a closure film, wherein a tamper-indicating band is provided that ensures that the closure film can be pierced by the means only when the tamper-indicating band has been removed, wherein the tamper-indicating band is between the closure bottom part and the cap, according to the features of the preamble of claim 1.

EP 0 214 095 [U.S. Pat. No. 4,722,449] discloses a container closure that can be fitted, for example screwed, onto a container, for example a plastic bottle. This container closure has a closure bottom part and a cap, and also a mouthpiece and means for piercing a closure. A tamper-indicating band is also provided that ensures that the closure film can be pierced by the means only when the tamper-indicating band has been removed.

A further development of such a container closure is disclosed in DE 10 2014 207 652. In this container closure, the tamper-indicating band is between the closure bottom part and the cap, wherein the circumferential bottom edge of the cap and the upper circumferential edge of the closure bottom part are connected to each other via at least one web designed as a film hinge. With this container closure, it is made possible for the cap to be able to be pivoted but at the same time to remain on the closure bottom part when the tamper-indicating band has been removed. In this way, the cap cannot be lost, such that it is possible for the container closure to be reclosed. Moreover, the cap remains permanently on the container closure, such that this unit can therefore be disposed of, preferably together with the bottle, for example can be sent for recycling.

However, in both of the aforementioned container closures, there is still the disadvantage that the tamper-indicating band is separated from the container closure after removal. This results in unnecessary waste material, since the tamper-indicating band cannot be sent for recycling and has to be disposed of by the user of the container closure. The object of the invention is to improve a container closure of the type in question such that no additional waste material arises from the handling of the container closure.

This object is achieved by the features of claim 1.

According to the invention, provision is made that the tamper-indicating band is designed as a closed ring that is connected to a bottom edge of the cap via at least one separable web, and the cap is mounted on the closure bottom part so as to be able to be rotated and pressed in respective regions. By virtue of the design of the tamper-indicating band as a closed ring, it remains on the container closure after the actuation of the cap, such that the generation of waste material is effectively avoided. After use, the container closure can be disposed of, if appropriate together with the container on which it is mounted. At the same time, the operation of the container closure is optimized, since the cap is mounted on the closure bottom part so as to be able to be rotated and pressed in respective regions. By virtue of the rotation movement of the cap relative to the closure bottom part, the closed ring, which is mounted axially but not rotatably on the closure bottom part, is separated from the cap, since the at least one web is severed by the rotation movement of the cap relative to the tamper-indicating band, which does not rotate therewith. The design of the at least one web, preferably of several webs, is chosen here such that a certain force needs to be applied to rotate the cap and to separate the at least one web from the tamper-indicating band in the process. After the separation, it is possible that the closed ring can move axially, that is to say along the longitudinal axis of the container closure. It moves away as it were from the bottom edge of the cap after the at least one web has been severed, a sufficient space being available for this movement.

After the cap has been rotated about a certain partial circumference relative to the closure bottom part, it reaches a position in which a pressing movement is possible. This position, in which the pressing movement is possible, can be realized by a corresponding limit stop. Once the cap has reached this point after the rotation, not only is the tamper-indicating band designed as a closed ring separated from the cap, but the cap can also be moved toward the lower part of the closure bottom part, that is to say toward the container, by application of a pressing force from above. As a result of this movement, the means for piercing the closure film are also entrained and separate this closure film. The separation of the closure film has the effect that a medium located in the closure bottom part, and initially arranged sealingly in the closure bottom part by means of the closure film, can pass into the container lying below.

Overall, the container closure according to the invention thus affords the advantage that the means for piercing the closure film can be actuated by a handling procedure that is easy to carry out, while at the same time the generation of waste material is effectively avoided. After their movement (separation of the tamper-indicating band, piercing of the closure film), all parts of the container closure remain on the container closure, which can thus be disposed of as a unit after use thereof, if appropriate together with the container, and can be advantageously sent for recycling.

In a development of the invention, the cap is formed by a lower part on which a pivot part is mounted. While the lower part is mounted captively on the closure bottom part so as to be able to be rotated and pressed, the pivot part can be moved relative thereto in order to permit access to the mouthpiece and to withdraw the content of the container. In this case, the pivot part is a separate part and can, for example, be mounted on the lower part by form-fit and/or force-fit engagement.

In a development of the invention, the pivot part is movable and captured on the lower part. While it is conceivable, as has already been described above, that the pivot part is a separate part from the lower part and may possibly be lost, the pivot part in this further configuration of the invention is at the same time movably and captively on the lower part. This affords the advantage that the pivot part can also be moved in order to make the mouthpiece accessible. At the same time, however, this pivot part is likewise secured captively on the lower part, such that the generation of waste material is also thereby avoided after the final use of the container closure.

In a development of the invention, the tamper-indicating band designed as a closed ring is on the bottom edge of the lower part of the cap via the at least one web. In this original state, the lower part of the cap and the tamper-indicating band are therefore initially connected to each other. If a force is now applied to the cap including the lower part, it is possible, on account of the admissible rotation movement of the cap and of the lower part thereof, that this element can be twisted relative to the closure bottom part. At the same time, however, the tamper-indicating band designed as a closed ring is mounted on the closure bottom part in such a way that an axial movement along the longitudinal axis of the container closure is possible, but a rotation movement is not possible. The force that is applied to the cap in order to rotate the latter thus rotates the cap with its lower part itself, but the closed ring cannot follow along with this rotation movement. As a result, the at least one web is separated. The separation is a visual indicator that the cap has been rotated. In addition, this visual perception of the separation of the tamper-indicating band is enhanced by the fact that the tamper-indicating band designed as a closed ring moves away from the circumferential bottom edge of the lower part of the cap. This additionally creates space for the bottom edge of the lower part to approach the tamper-indicating band when a pressing force is applied to the cap, by which pressing force the means for piercing the closure film are actuated.

In a development of the invention, a distance of the bottom edge of the tamper-indicating band from an upper edge of the closure bottom part corresponds at least to the path that can be traveled by the means for piercing the closure film. This ensures that the tamper-indicating band designed as a closed ring cannot obstruct the axial path of the cap when a pressing force is applied to it. At the same time, this path is so dimensioned that the means for piercing the closure film are also moved along such a path, which opens the closure film at least to such an extent that the medium located therein can move toward the container located below.

An illustrative embodiment of a container closure according to the invention and its function are described below and explained with reference to the figures.

FIGS. 1 to 11 show a container closure 1 with a cap 2 in various views and functional stages.

Figure 2:
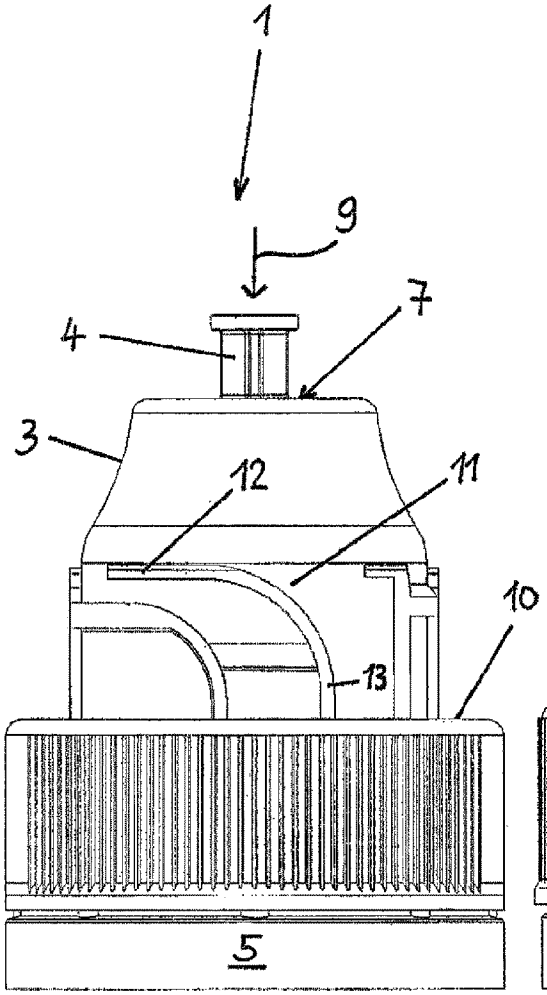
Figure 3:
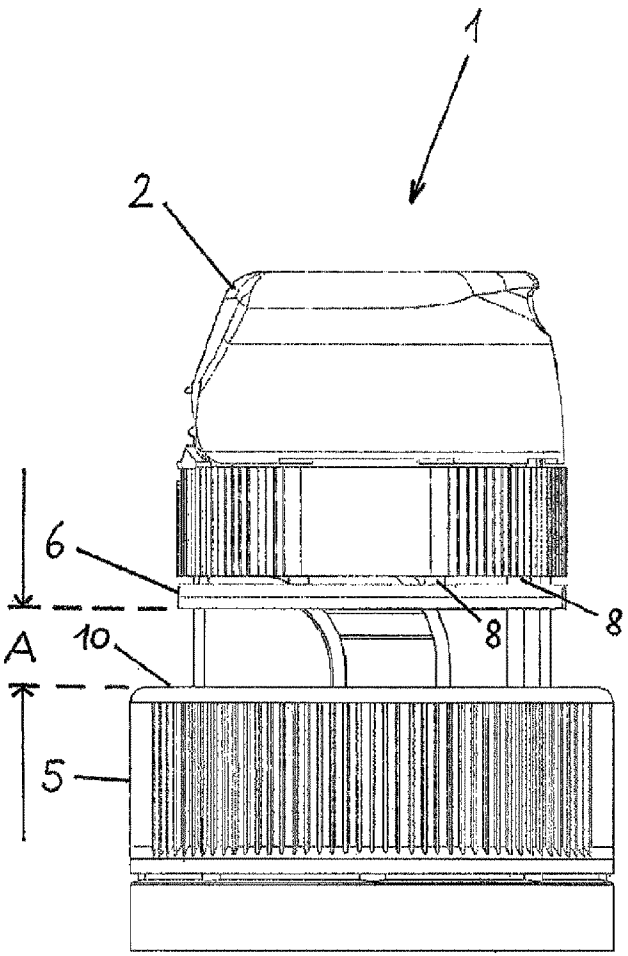

FIGS. 1 to 3 show that the container closure 1 has a mouthpiece 3, a perforator 4 as means for piercing a closure film (not shown), and a closure bottom part 5 with a tamper-indicating band 6. An opening 7, directed upward as seen in FIGS. 1 to 3, is provided in the mouthpiece 3, and the perforator 4 is arranged sealingly in its starting position in this opening 7. As can be seen, the perforator 4 projects a distance above the top of the mouthpiece 3.

FIG. 1 shows that the tamper-indicating band 6 is a closed ring and is mounted on the bottom edge of the cap 2 via a web, preferably several webs 8 distributed about the circumference.

FIG. 2 shows that the perforator 4 projects a distance above the upper end of the mouthpiece 3 and is configured such that it can be moved axially into the closure bottom part 5 when pressure is applied in an axial direction 9. When this has occurred, the upper part of the perforator 4 is no longer fitted sealingly in the mouthpiece 3, more precisely the opening 7 of the latter, and therefore the contents of the container (not shown here) on which the container closure 1 is mounted can be removed, for example can be drunk.

FIG. 2 also shows a rotation guide for the cap 2, just like locking means by which the cap 2 is secured on the closure bottom part 5 after the rotation movement has been performed. After this securing, the cap 2 can no longer be rotated any further, but it can execute an axial movement (parallel to the axial direction 9). The cap 2 is thus twisted, and the tamper-indicating band 6 tears off. A stop is provided here to block further rotation of the cap 2 and divert the movement axially. However, only after the cap 2 has been pressed in is it engaged with and secured to the closure bottom part 5. Thereafter, the cap 2 cannot be twisted, nor can it be moved axially. This means that a rearward movement of the cap 2 is no longer possible. This is advantageously optionally realized, so that the container closure 1 can no longer move relative to the container on which it is arranged. Release of the container closure 1 from the container is also facilitated by this.

Means (not shown), for example locking means or the like, are also present that have the effect that the tamper-indicating band 6 is secured with respect to the closure bottom part 5 in such a way that it does not follow a rotation of the cap 2 (as a result of which the at least one web 8 is separated), but an axial movement (likewise along the axial direction 9) is possible. After the separation of the at least one web 8 and therefore the release of the tamper-indicating band 6 from the cap 2, the latter is able to move axially toward an upper edge 10 of the closure bottom part 5 without executing a rotation movement. A space is available for this, since a distance A is available (FIG. 1) between the circumferential bottom edge of the tamper-indicating band 6 designed as a closed ring and the upper edge 10. This distance A is at least exactly as great as the upper part of the perforator 4 protruding above the top of the mouthpiece 3. This distance A is indicated in FIG. 3. Rotation of the cap 2 thus not only ensures that the tamper-indicating band 6 is released from the cap 2 and remains on the closure bottom part 5, but the free space then present between the circumferential bottom edge of the cap 2 and the upper circumferential edge of the tamper-indicating band 6 (that lies on the upper edge 10 of the closure bottom part 5) permits an axial movement of the perforator 4 in axial direction 9 along a path that corresponds to the distance A, in order to move the perforator 4 into the interior of the closure bottom part 5 and thereby pierce the closure film.

The mouthpiece 3 has a guide groove 11 along which a correspondingly configured and inwardly facing projection, for example a pin (round, square, elongate or the like), of the cap 2 slides during the rotation and pressing movement of the cap 2 and is thereby guided. The guide groove 11 has a horizontal portion 12 and a vertical portion 13 (as seen in FIG. 2), wherein a transition (angled, for example right-angled, stepped or, as shown, arc-shaped) is present between these two portions 12, 13. If the cap 2 is now rotated about the mouthpiece 3, the projection on the cap 2 first runs in the horizontal portion 12. During this partial movement, the interaction between the projection on the cap 2 and the horizontal portion 12 prevents a movement of the cap 2 in axial direction 9. However, during this partial movement, the at least one web 8 is separated, because the cap 2 executes the partial movement (rotation), but the tamper-indicating band 6 cannot follow along with this movement because of its correspondingly being secured, for example via locking means, since the means present (but not shown) between tamper-indicating band 6 and cap 2 permit only a movement of the tamper-indicating band 6 in axial direction 9. When the projection on the cap 2 passes the transition between the two portions 12, 13 into the vertical portion 13 of the guide groove 11, the cap 2 can be moved downward (in axial direction 9) in a further partial movement (pressing movement or axial movement). The tamper-indicating band 6 is here already released from the cap 2 such that, after a complete movement (rotating and pressing movement) of the cap 2, the circumferential bottom edge of the latter comes to bear parallel to the circumferential upper edge of the tamper-indicating band 6. The circumferential bottom edge of the tamper-indicating band 6 is here oriented parallel to the upper edge 10, preferably also bearing thereon. The dimension "A" is thus reduced.

According to the configuration of the guide groove 11 in FIG. 2, the transition from the rotation movement to the pressing movement advantageously takes place in a harmonious and flowing manner, such that this transition is not noticed by a user. Both the release of the tamper-indicating band 6 and the pressing-in of the perforator 4 for piercing the separating film are thus performed with just one movement of the hand. In this process, the dimension "A" is thus reduced, as far as "A" equals zero.

As long as the projection on the cap 2 is located in the horizontal portion 12 of the guide groove 11, it can only be rotated and cannot be pressed (axially moved). Only after the transition from the horizontal portion 12 toward the vertical portion 13 is a purely axial movement or a combination of rotation movement and pressing movement permitted.

Figure 6:
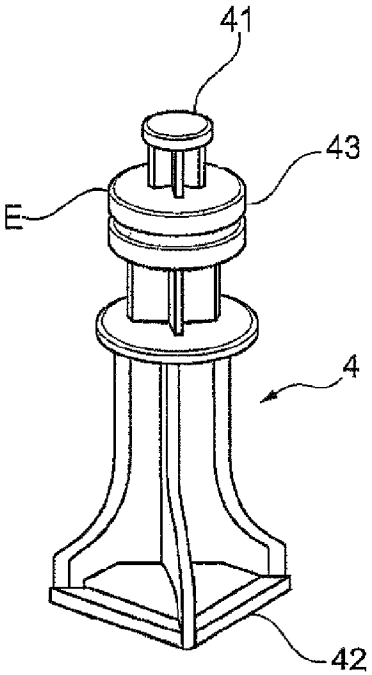
Figure 5:
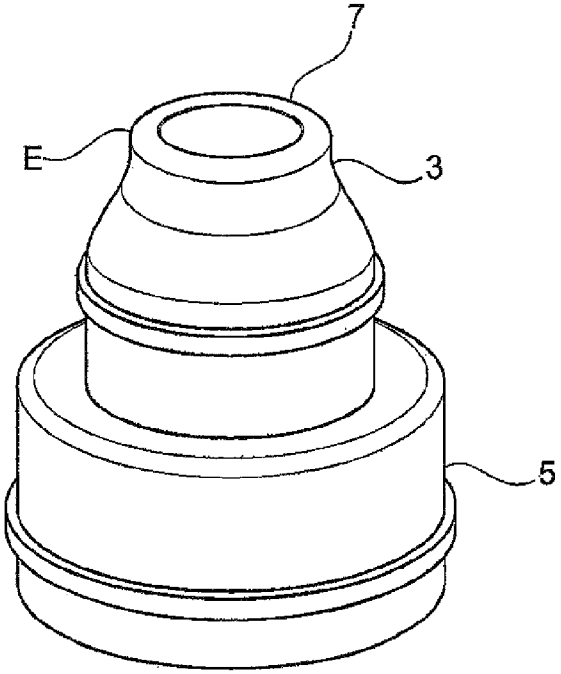
Figure 4:
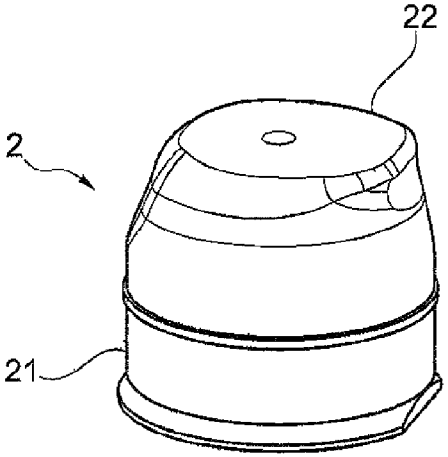

FIGS. 4 to 6 show details of the required elements of the container closure 1.

FIG. 4 shows the cap 2, which has a lower part 21 and a pivot part 22 preferably mounted captively thereon. While the lower part 21 is mounted on the closure bottom part 5 so as to be rotatable and axially movable, the pivot part 22 can be pivoted from the lower part 21 in order to free the opening 7 or to close the latter.

FIG. 5 is a detailed view of the closure bottom part 5 with its mouthpiece 3, wherein the opening 7 (here without perforator 4) is shown at the upper end of the mouthpiece 3.

FIG. 6 shows an example of a detailed configuration of a perforator 4, which has a pressing formation 41 at its one end, a piercing formation 42 at its other end and, between these, at least one sealing formation 43. As can also already be seen from FIGS. 1 to 3, the pressing formation 41 is outside the upper end of the mouthpiece 3. The at least one sealing formation 43 is present in a plane E, thus being arranged in the plane E in which the opening 7 is located (FIG. 5), such that this opening 7 is closed in the original state by the sealing formation 43. The piercing formation 42 is located, for example, in a plane lying slightly above the plane in which the circumferential bottom edge of the closure bottom part 5 is arranged. A closure film is also arranged in the plane in which the circumferential bottom edge of the closure bottom part 5 lies, such that the interior of the closure bottom part 5, in which essential parts of the perforator 4 and of a freely selectable medium are located, is closed by the closure film on the one hand and by the sealing formation 43 on the other hand. When a force is applied to the pressing formation 41, the perforator 4 is moved along its longitudinal axis toward the closure bottom part 5, as a result of which, on the one hand, the opening 7 is freed, and, on the other hand, the closure film (not shown) is pierced by means of the piercing formation 42.

FIGS. 7 to 11 show the function of such a container closure 1, i.e. a method for operating such a container closure 1.

FIG. 7 shows the delivery state, in which the tamper-indicating band 6 is still mounted on the cap 2 via its at least one web 8, and the cap 2 is on the closure bottom part 5. In this state, the perforator 4 projects with its pressing formation 41 a distance above the upper edge of the mouthpiece 3.

FIG. 8 shows the next step, in which the cap 2 is moved in rotation along a partial circumference (rotation movement R), wherein the cap 2 can be rotated a distance until it reaches a defined end position. With the start of the rotation, and until the end position of the cap 2 is reached at the end of the rotation movement, the at least one web 8 is separated and the tamper-indicating band can move axially toward the upper edge 10 of the closure bottom part 5.

FIG. 9 shows that the cap 2 has been pressed toward the upper edge 10 of the closure bottom part 5 on account of a pressing movement D, wherein, on the one hand, the circumferential bottom edge of the cap 2, in particular the lower part 21 thereof, approaches and even comes to bear on the upper circumferential edge of the tamper-indicating band 6 designed as a closed ring, and, on the other hand, the perforator 4 is moved into the interior of the closure bottom part 5. It will be seen here that the underside of the piercing formation 42 pierces the closure film (not shown) that lies in the plane in which the circumferential bottom edge of the closure bottom part 5 is also located.

FIG. 10 shows the next step, in which the opening 7 in the mouthpiece 3 can be made accessible by moving the pivot part 22 along a pivoting movement V, while at the same time the lower part 21 remains on the closure bottom part 5. In a simple configuration for providing access to the opening 7 in the mouthpiece 3, it could also be conceivable to form the cap 2 in one piece or to make the pivot part 22 releasable and thus separable from the lower part 21.

FIG. 11 shows the last step, in which the pivot part 22 can be moved back in the opposite pivoting direction V, such that the opening 7 in the mouthpiece 3 is closed again by means of the cap 2 and, consequently, the container is sealed off from its external environment.

The opening and closing procedure shown in FIGS. 10 and 11 can of course be carried out a number of times.

List of reference signs

| | | | |
|---|---|---|---|
| 1 | container closure | 5 | closure bottom part |
| 2 | cap | 6 | tamper-indicating band |
| 21 | lower part | 7 | opening |
| 22 | pivot part | 8 | web |
| 3 | mouthpiece | 9 | axial direction |
| 4 | perforator | 10 | upper edge |
| 41 | pressing formation | 11 | guide groove |
| 42 | piercing formation | 12 | horizontal portion |
| 43 | sealing formation | 13 | vertical portion |

The invention claimed is:

1. A container closure comprising:

a closure bottom part;

a cap;

a mouthpiece;

means for piercing a closure film;

a tamper-indicating band that ensures that the closure film can be pierced by the means only when the tamper-indicating band has been removed, the tamper-indicating band being between the closure bottom part and the cap and being a closed ring; and a separable web securing the closed ring to a bottom edge of the cap, the cap being mounted on the closure bottom part so as to be able to be rotated and pressed in respective regions.

2. The container closure according to claim 1, wherein the cap is formed by a lower part on which a pivot part is mounted.

3. The container closure according to claim 2, wherein the pivot part is movable and captured on the lower part.

4. The container closure according to claim 1, wherein a distance of the bottom edge of the tamper-indicating band from an upper edge of the closure bottom part corresponds at least to the path that can be traveled by the means for piercing the closure film.

5. The container closure according to claim 4, wherein the means for piercing the closure film is a perforator.

6. The container closure according to claim 5, wherein the perforator has a pressing formation, a piercing formation and, lying therebetween, at least one sealing formation.

7. The container closure according to claim 1, wherein the tamper-indicating band, after separation from the cap, is between a bottom edge of the cap and an upper edge of the closure bottom part.

8. The container closure according to claim 1, wherein the mouthpiece has a guide groove and the cap has a projection facing toward the guide groove and interacting therewith.

9. The container closure according to claim 8, wherein the guide groove has a horizontal portion and a vertical portion and an arc-shaped transition is provided between these two portions.

* * * * *